US006244177B1

(12) United States Patent
Young

(10) Patent No.: US 6,244,177 B1
(45) Date of Patent: Jun. 12, 2001

(54) FINGER COT HAVING STAMP PAD WITH POSTAL RELATED INDICIA

(76) Inventor: Michael E. Young, 42 Euclid Ave., San Leandro, CA (US) 94577

( * ) Notice: Subject to any disclaimer, the term of this patent is extended or adjusted under 35 U.S.C. 154(b) by 0 days.

(21) Appl. No.: 09/507,698

(22) Filed: Feb. 22, 2000

(51) Int. Cl.[7] ..... B41K 1/50; A46B 5/04

(52) U.S. Cl. ..... 101/371; 101/333; 294/25; 2/21; 401/7

(58) Field of Search ..... 101/327, 333, 101/368, 371, 103, 109, 405, 406; 401/7, 8; 294/25; 2/21

(56) References Cited

U.S. PATENT DOCUMENTS

| | | | | |
|---|---|---|---|---|
| 446,540 | * | 2/1891 | Smith | 101/333 |
| 659,135 | * | 10/1900 | Davies | 401/7 |
| 969,898 | * | 9/1910 | Ortiz | 401/8 |
| 1,018,308 | * | 2/1912 | Ferguson | 401/7 |
| 2,717,799 | * | 9/1955 | Jones | 294/25 |
| 3,263,681 | | 8/1966 | Nechtow et al. | 128/157 |
| 3,348,541 | | 10/1967 | Loebeck | 128/157 |
| 3,597,099 | * | 8/1971 | Tollin et al. | 101/368 |
| 3,728,736 | | 4/1973 | Pugh | 2/21 |
| 3,985,383 | | 10/1976 | Yonkers | 294/25 |
| 4,694,843 | | 9/1987 | Casenhiser | 132/73 |
| 4,763,940 | | 8/1988 | Held | 294/25 |
| 4,927,695 | * | 5/1990 | Ooms et al. | 101/333 |
| 5,640,713 | | 6/1997 | Ping | 2/21 |
| 5,761,743 | | 6/1998 | Andrews et al. | 2/21 |
| 6,098,535 | * | 8/2000 | Lynn | 101/109 |

* cited by examiner

*Primary Examiner*—John S. Hilten
*Assistant Examiner*—Leslie J. Grohusky
(74) *Attorney, Agent, or Firm*—Patent & Trademark Services; Thomas Zack; Joseph H. McGlynn

(57) ABSTRACT

A multi-purpose thumb or finger mounted cot having a stamp pad with postal related indicia. Two embodiments of the cot are disclosed one of which is closed on its upper end while the other cot is opened on both ends. The postal related indicia on the self-inking stamp pad may consist of a carrier routing number and a plurality of parallel bar lines. This indicia is raised from a base pad surface with the bar lines used to endorse mail by postal carriers, to cancel stamps and wrong bar codes, wrong zip codes, and to cancel bar codes that have mistakenly not been canceled in the mailing process. The carrier routing number specifically identifies a postal carrier and can inform one of the route assigned to that carrier. By making the mating surfaces of the stamp pad (back) and cot (front) hook and loop or VELCRO fastener elements, the stamp pad can be removed and replaced with another stamp pad or have its ink supply refilled when needed. This replaced stamp pad may be that of any carrier with different indicia. Using the thumb or finger mounted stamp pad saves a considerable amount of time in processing mail since there is not need to look for or used separate hand held stamps.

2 Claims, 2 Drawing Sheets

FINGER COT HAVING STAMP PAD WITH POSTAL RELATED INDICIA

BACKGROUND OF THE INVENTION

This invention relates to a finger worn device that can be used for multiple postage related matters purposes.

Finger cots having long been used by medical personnel and office personnel to protect the ends of their fingers and to increase traction between the fingers and engaged objects. In many cases the outer surface of such cots can be made of a fibrous character that is woven, knitted, netted or matted to increase traction.

In at least one case, a finger cot is used as a bandage and has an adhesive strip to hold the bandage on the user's finger. Another cot was designed as a thumb or finger guard and had a dropped curved gripping surface on the front portion.

One indexing device includes a layer of film and pressure sensitive adhesive material located on at least a portion of one side of the layer of film to enable the layer of film to adhere to an object such as a finger. The other side of the layer has material with a very high coefficient of friction to resist the movement of that side over a sheet of paper.

Another type of fingertip protector cot has a cavity comprised of an open-end protector portion and a closed-end protector portion separated by a finger-stopping barrier. A document handling aid has a resilient tubular body with opened ends. A first body section has the tip of the user's finger protruding therefrom while the second adjacent section grips the finger about the first knuckle with a plurality of parallel cuts to permit expansion.

A shock absorbing finger-tip protector has a protruding shock absorbing mechanism with a resilient surface. Still another finger cot is formed of two blanks welded together by ultra sonic welding.

DESCRIPTION OF THE PRIOR ART

Finger protective cots or sheaths can be constructed in a variety of different designs. For example, in U.S. Pat. No. 3,263,681 to Nechtow et al. there is disclosed a medical finger cot made of a fibrous character that is woven, knitted, netted or matted to increase traction.

U.S. Pat. No. 3,348,541 to Loebeck discloses a finger cot is used as a bandage and has an adhesive strip to hold the bandage on the user's finger.

U.S. Pat. No. 3,728,736 to Pugh discloses a thumb or finger guard with a dropped curved gripping surface on the front portion.

U.S. Pat. No. 3,985,383 to Yonkers, while not a finger cot per se, discloses a related indexing device that includes a layer of film and pressure sensitive adhesive material located on at least a portion of one side of the layer of film to enable the layer of film to adhere to an object such as a finger. The other side of the layer has material with a very high coefficient of friction to resist the movement of that side over a sheet of paper.

U.S. Pat. No. 4,694,843 to Casenhiser discloses another type of fingertip protector cot which has a cavity comprised of an open-end protector portion and a closed-end protector portion separated by a finger-stopping barrier.

U.S. Pat. No. 4,763,940 to Held discloses a document handling aid has a resilient tubular body with opened ends. A first body section has the tip of the user's finger protruding therefrom while the second adjacent section grips the finger about the first knuckle with a plurality of parallel cuts to permit expansion.

U.S. Pat. No. 5,640,713 to Ping discloses a shock absorbing finger-tip protector that has a protruding shock absorbing mechanism with a resilient surface.

U.S. Pat. No. 5,761,743 to Andrews et al. discloses a finger cot formed of two blanks welded together by ultra sonic welding.

In the present invention, a thumb or finger cot has a stamp pad with identifying indicia on the postal carrier and bar lines held to the surface of the cot all as will be detailed in the specification that follows hereafter.

SUMMARY OF THE INVENTION

This invention relates to a multi-purpose mini stamper used in the postal field that can be worn on the thumb or a finger of the user.

It is the primary object of the present invention to provide for the improved mini multi-use stamping device that can be worn on the thumb or finger of a user.

Another object is to provide for such device whose stamp has identifying indicia on the carrier's route and bar lines to cancel uncanceled stamps and bar codes.

These and other objects and advantages of the present invention will become apparent to readers from a consideration of the ensuing description and the accompanying drawings.

DESCRIPTION OF THE PREFERRED EMBODIMENT

Figure 1:
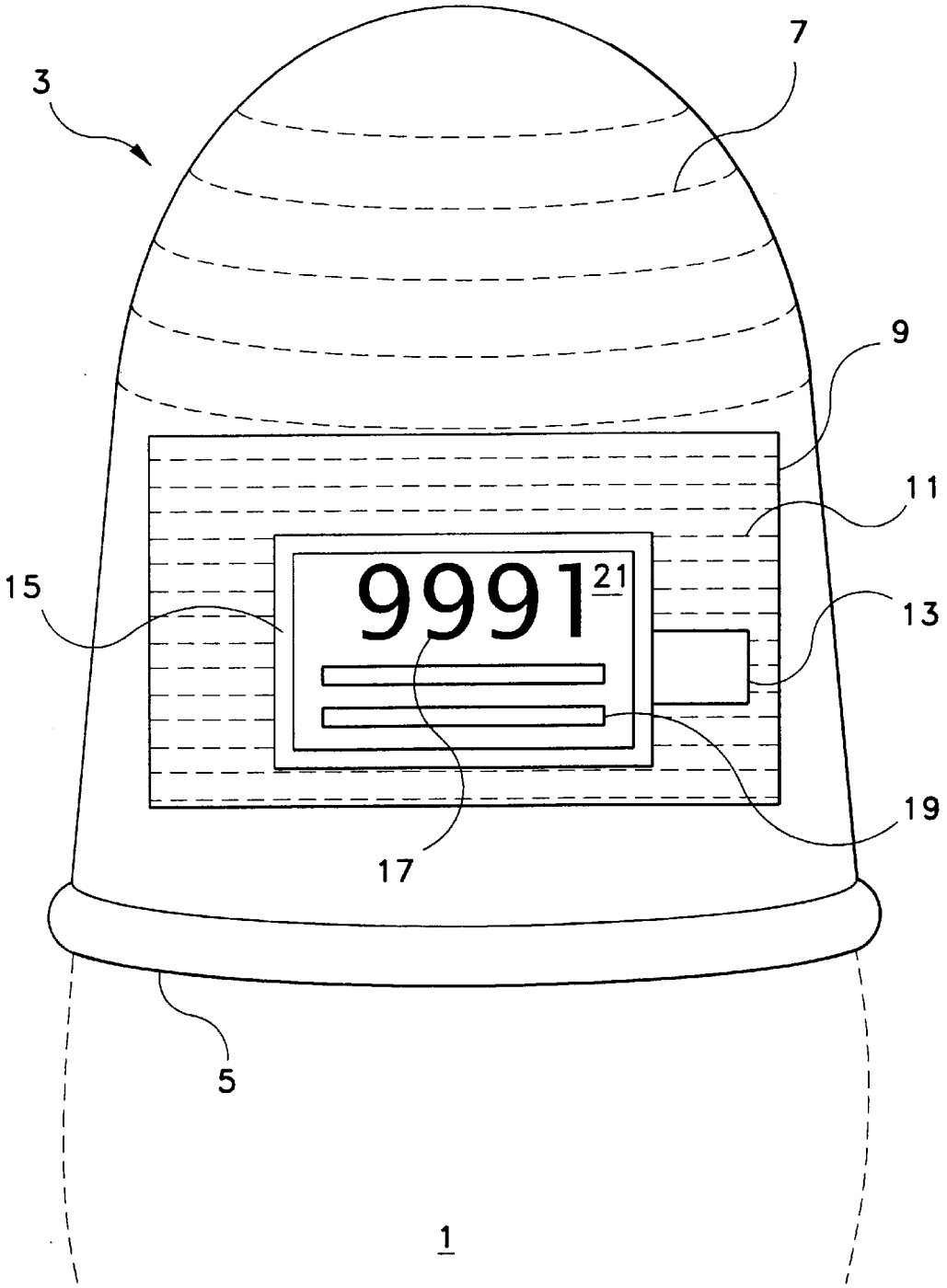
FIG. 1 is a front view of one embodiment of the present invention.

FIG. 1 is a front view of one embodiment of the present invention. In this first embodiment designed primarily for use with a user's thumb 1, shown in dotted line format, has a closed upper end rubber sheath or cot 3 with a lower thumb or finger receiving opening 5. Small separated rows of rubber surface ridges 7 are spaced about the outer surface of or the cot to increase frictional contact with engaged objects, such as letters. Fixed to the surface of cot 3 is a rectangular shaped backing member 9 whose outer surface 11 (e.g., the female surface) contains one of the engaging surfaces of a hook and loop or VELCRO fastener. A strip 13 contains the other engaging surface (e.g., the male surface) and faces towards the surface 11 to mate therewith. Elongated strip 13 extends across all of most of the width of the back surface of pad 15 to which it is attached and has its the hook and loop engaging surface facing toward the mating surface 11.

Fixed to the strip 13 is the self inking stamp pad 15. This stamp pad has surface indicia which indicate both the carrier route number 17 and two parallel bar lines 19. As is common, these indicia on the stamp pad extend slightly upwardly from the base supporting pad surface 21 such that when the pad is pressed against a surface, like that of a letter, an ink representation of the indicia will be left on the letter. The three or four digit carrier route number 17 designates a specific individual carrier responsible for carrying and distributing mail to a specific defined route.

The bar lines 19 are used to cancel stamps, uncancel stamps, cancel wrong bar codes as well as cancel wrong zip codes which have mistakenly not been canceled. Since, the rubber material making up the cot 3 is flexible, a user may imprint the indicia on the engaged object by pushing out their underlying hand appendage. If desired, the hook and loop engaged fasteners 11 and 13 allow the stamp pad 15 to be removed from the cot's surface to replace them with another stamp pad having different indicia or to add ink should the same be necessary. Clearly, a skillful user can save a considerable amount of processing time when using this invention to stamp information on a letter rather than using one or two separate hand held stamps since these stamps or stamp are not carried and therefore not readily available.

Figure 2:
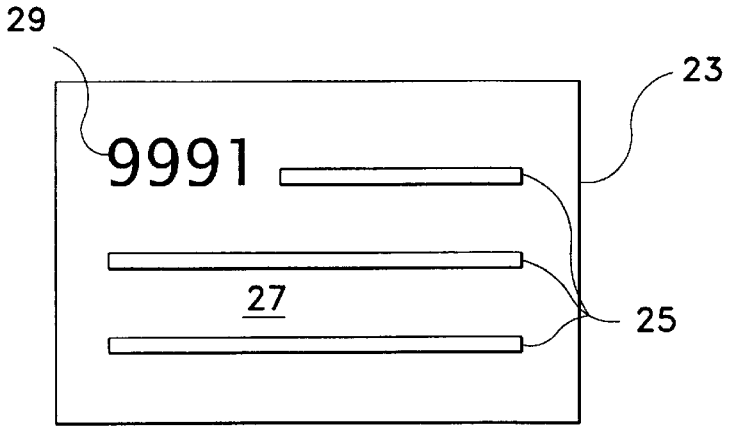
FIG. 2 illustrates a stamp pad usable with either the first or second embodiment of the invention.
Figure 3:
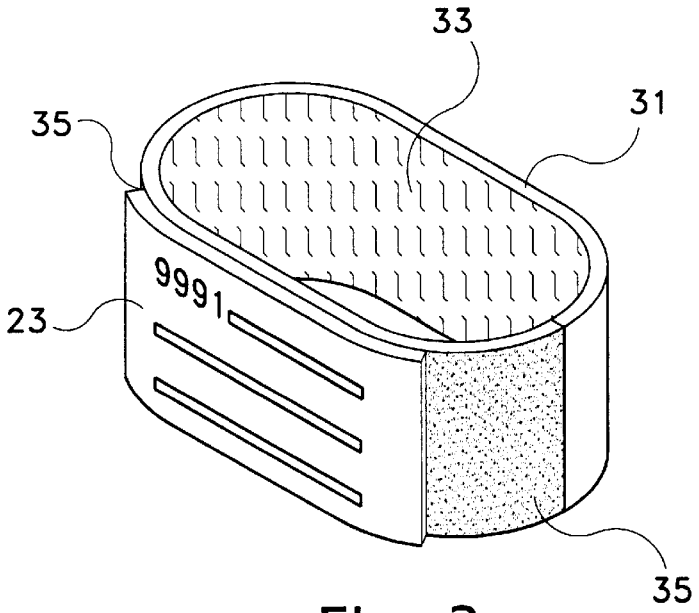
FIG. 3 shows a perspective view of the FIG. 2 stamp pad used with a second embodiment of the invention.

FIG. 2 illustrates a stamp pad 23 that can be used with either the first embodiment of the invention shown in FIG. 1 or with the second embodiment of the invention shown in FIG. 3. Like the stamp pad 15 of FIG. 1, the slightly different stamp pad 23 has a rear surface hook or loop surface. In this case however, the total back surface of pad 23 facing towards the engaging outer hook or loop surface on the cot is substantially made up of the mating hook or loop material, rather than just a strip which extends across the width of the pad. The front facing surface of pad 23 is also slightly different in make up from the pad surface shown in FIG. 1. In this second pad 23 there are three parallel lines 25 which raise up from the underlying base surface 27 with the upper most line being adjacent the raised carrier routing number indicia data 29. The pad 23 is generally rectangular and has a thickness considerably less than either its width(direction of lines 25) or its height. In one embodiment of the pad its width was one inch, its height 0.75 of an inch and it had a thickness of 0.25 of an inch.

FIG. 3 shows a perspective view of the stamp pad of FIG. 2 attached to a second embodiment of a finger cot 31. In this second embodiment the cot 31 resembles a ring-like structure having two opened opposite ends. Thus, as used in this invention, the term "cot" encompasses sheath members having one or two opened ends. The inner surface of the cot 31 has one of the two mating outer surface 33 which mates with the other of the hook and loop mating surfaces on the pad 23's facing back surface. Optional added side extensions 35 to this pad mating hook and loop back surface are shown in this figure. In any event, the stamp pad 23 functions as before to leave either identifying data on the carrier's routing number or the three horizontal bar code lines, or both, when pressed against the outer surface of a letter, package or the like.

Figure 4:
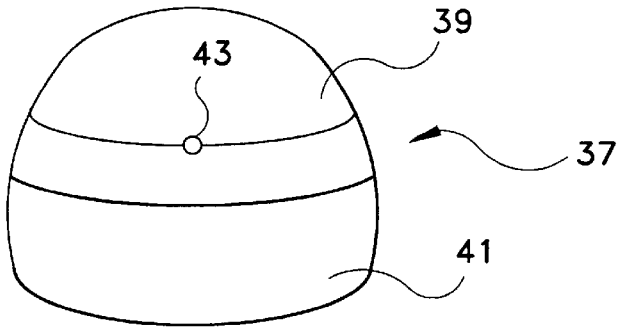
Fig. 4 PRIOR ART
FIG. 4 is a perspective view of the container used to retain either embodiment of the present invention.

FIG. 4 is a perspective view of a closed conventional plastic container 37 that can be used to retain either embodiment of the present invention. The upper lid 39 may be pivotally fastened to the lower bottom member 41 or may rest on internal surface ridge around the mating surface edges of the bottom. When in closed container position, as shown, a fastener 43 may be used to retain the lid and its bottom together including their internal contents. Other types of conventional containers can also be used to retain either embodiment of the present invention when not in use.

In use, any of the two described embodiments of the cots may fit around a thumb or any finger of a user preferably the index or middle finger.

Although the preferred embodiment of the present invention and the method of using the same has been described in the foregoing specification with considerable details, it is to be understood that modifications may be made to the invention which do not exceed the scope of the appended claims and modified forms of the present invention done by others skilled in the art to which the invention pertains will be considered infringements of this invention when those modified forms fall within the claimed scope of this invention.

What I claim as my invention is:

1. A stamp assembly comprising:

a cot adapted to fit around an appendage of the hand of a user, said cot having an outer surface with a first outer surface portion and an opened lower appendage receiving end;

said cot having spaced rows of ridges about the outer surface to increase frictional contact with objects engaged by the surface;

an inked stamp pad having a second outer surface portion which can engage and is removably mountable to the first outer surface portion of said cot, said stamp pad having a pad surface with upwardly extending indicia indicating a routing number of a postal carrier and a plurality of bar lines.

2. The stamp assembly of claim 1, wherein said first outer surface portion and said second outer surface portion consists of hoop and loop fastener surfaces with one of said fastener surfaces being on each of the first outer surface portion and another on the second outer surface portion.

* * * * *